US006129562A

United States Patent [19]

Hong

[11] Patent Number: 6,129,562

[45] Date of Patent: Oct. 10, 2000

[54] STRADDLE MOUNTING TYPE MEMORY CARD CONNECTOR

[75] Inventor: Kwen Ming Hong, Tao-Yuan Hsien, Taiwan

[73] Assignee: Speed Tech Corp., Tao-Yuan Hsien, Taiwan

[21] Appl. No.: 09/414,017

[22] Filed: Oct. 6, 1999

[30] Foreign Application Priority Data

Dec. 18, 1998 [TW] Taiwan ..... 87221076

[51] Int. Cl.[7] ..... H01R 9/09; H01R 13/648; H01R 13/64

[52] U.S. Cl. ..... 439/79; 439/64; 439/607

[58] Field of Search ..... 439/64, 79, 607, 439/377

[56] References Cited

U.S. PATENT DOCUMENTS 5,308,251 5/1994 Kaufman et al. ..... 439/64
5,584,708 12/1996 Leong ..... 439/79
5,662,482 9/1997 Shin ..... 439/64
5,940,275 8/1999 Laity ..... 361/737

*Primary Examiner*—Gary F. Paumen
*Assistant Examiner*—Edwin A. León
*Attorney, Agent, or Firm*—Pro-Techtor International Services

[57] ABSTRACT

A straddle mounting type memory card connector installed in a circuit board to receive a memory card, including a connector body, the connector body having two parallel arms and two locating blocks respectively formed integral with the arms at one end, the locating blocks each having a horizontal coupling groove respectively forced into engagement with the wall thickness of the circuit board, a metal supporting plate fastened to the arms of the connector body by a plug joint to protect the arms of the connector body against deformation, two horizontal rows of terminals mounted in the connector body at different elevations and clamped on top and bottom side wall of the circuit board, and two metal grounding members respectively mounted in the arms of the connector body and connected between the metal supporting plate and a respective grounding terminal at the circuit board.

11 Claims, 3 Drawing Sheets

STRADDLE MOUNTING TYPE MEMORY CARD CONNECTOR

BACKGROUND OF THE INVENTION

The present invention relates to a memory card connector for mounting on a circuit board to hold a memory card, and more particularly to such a straddle mounting type memory card connector, that can be directly and horizontally clamped on the circuit board to hold a memory card at one side of the circuit board.

A regular memory card connector is generally comprised of a connector body, and two vertically spaced rows of terminals mounted in the connector body. The terminals each have a contact end and a soldering end arranged at right angles. The contact end of each terminal is provided for plugging into a respective contact hole at the memory card. The soldering end of each terminal is bonded to a pad at the circuit board by SMT (surface mounting technology). Because the connection between The straddle mounting type memory card connector and the circuit board is achieved simply by soldering the soldering end of each of the terminals to the pad at the circuit board, the terminals tend to be broken. Further, because the terminals have a substantially L-shaped profile, and are respectively soldered to the circuit board, The straddle mounting type memory card connector requires much installation space. When installed, the whole assembly of the circuit board and The straddle mounting type memory card connector has a certain height.

SUMMARY OF THE INVENTION

It is one object of the present invention to provide a straddle mounting type memory card connector, which enables the connector body to be directly fastened to the circuit board during its installation, so that the whole assembly can positively be secured to the circuit board. It is another object of the present invention to provide a straddle mounting type memory card connector, which is directly clamped on top and bottom side walls of the circuit board to minimize the combined height after its installation in the circuit board. It is still another object of the present invention to provide a straddle mounting type memory card connector, which has means to protect the connector body against deformation. It is still another object of the present invention to provide a straddle mounting type memory card connector, which has means to eliminate static electricity upon installation of a memory card. To achieve these and other objects of the present invention, there is provided a straddle mounting type memory card connector, which comprises a connector body, the connector body having two parallel arms and two locating blocks respectively formed integral with the arms at one end, the locating blocks each having a horizontal coupling groove respectively forced into engagement with the wall thickness of the circuit board, a metal supporting plate fastened to the arms of the connector body by a plug joint to protect the arms of the connector body against deformation, two horizontal rows of terminals mounted in the connector body at different elevations and clamped on top and bottom side wall of the circuit board, and two metal grounding members respectively mounted in the arms of the connector body and connected between the metal supporting plate and a respective grounding terminal at the circuit board.

DETAILED DESCRIPTION OF THE PREFERRED EMBODIMENT

Figure 1:
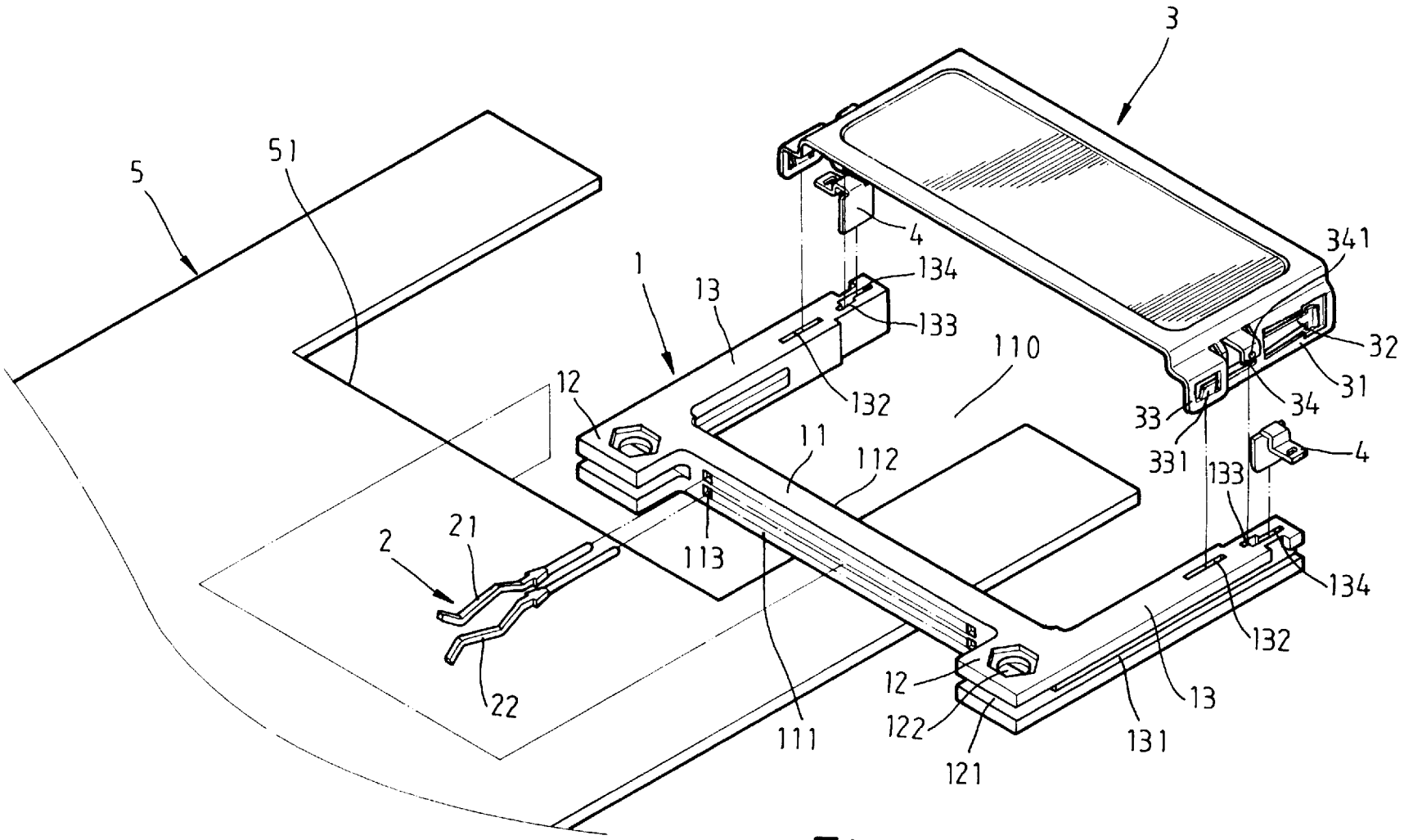
FIG. 1 is an exploded view of a straddle mounting type memory card connector according to the present invention.
Figure 2:
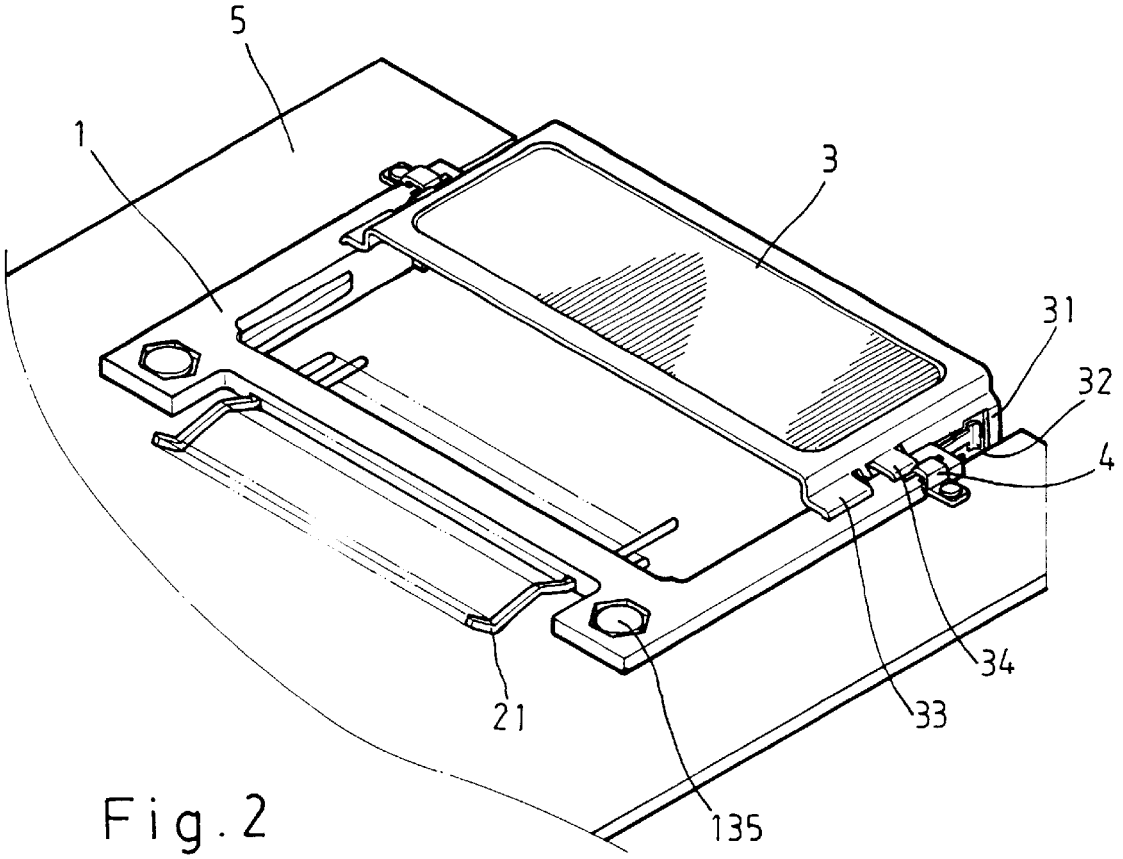
FIG. 2 is a perspective assembly view of the straddle mounting type memory card connector according to the present invention.
Figure 3:
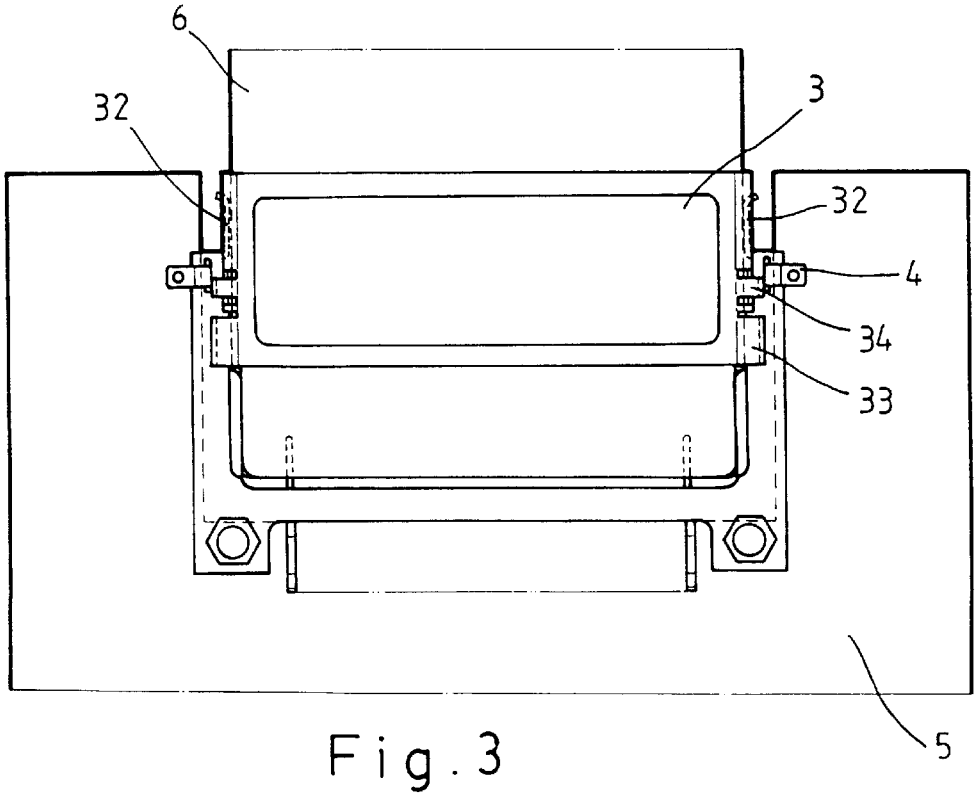
FIG. 3 is a top plain view of the present invention, showing a memory card inserted into the memory card connector.
Figure 4:
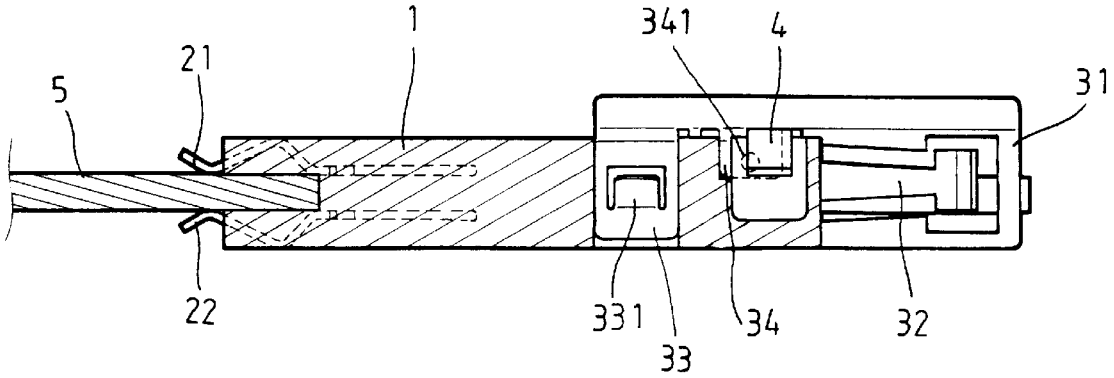
FIG. 4 is a sectional side view of the present invention.

Referring to FIGS. from 1 through 4, a straddle mounting type memory card connector is shown comprised of a connector body 1, a plurality of terminals 2, a supporting plate 3, and two metal grounding members 4. The connector body 1 comprises an elongated terminal holder base 11, and two parallel arms 13 perpendicularly extended from two distal ends of the terminal holder base 11 and defining a receiving space 110. The terminal holder base 11 has a coupling face 111 at a back side thereof, a bearing face 112 at a front side thereof, two vertically spaced rows of terminal slots 113 respectively extended through the coupling face 111 and the bearing face 112 for receiving the terminals 2. The terminals 2 include first terminals 21 and second terminals 22 respectively mounted in the two vertically spaced rows of terminal slots 113, each having rear end extended out of the coupling face 111 and soldered to a circuit board 5 and a front end extended out of the bearing face 112 into the receiving space 110 for connection to a memory card 6 (see FIG. 3). The connector body 1 further comprises two locating blocks 12 respectively formed integral with the arms 13 at one end remote from the receiving space 110, and protruded over the coupling face 111 of the terminal holder base 11. The locating blocks 12 each comprise a horizontal coupling groove 121 for engagement with the wall thickness of the circuit board 5 upon insertion of the connector body 1 into an opening 51 at the circuit board 5, and a vertical screw hole 122 disposed in communication with the horizontal coupling groove 121 for the installation of a screw 135 to fix the connector body 1 to the circuit board 5 after engagement of the horizontal coupling groove 121 at each locating block 12 with the wall thickness of the circuit board 5. The arms 13 each have a sliding groove 131 longitudinally extended along the length thereof at an outer side and perpendicularly disposed in communication with the horizontal coupling groove 121 at the corresponding locating block 12. The height of the sliding groove 131 is approximately equal to the thickness of the circuit board 5, so that two opposite side edges of the opening 51 at the circuit board 5 can be respectively inserted into the sliding grooves 131 at the arms 13 of the connector body 1, to guide the connector body 1 into positive engagement with the circuit board 5. Each arm 13 further comprises a first plug hole 132, a second plug hole 133, and a guide hole 134 in communication with the second plug hole 133 at one side. The supporting plate 3 is a flat, elongated metal plate fastened to the arms 13 of the connector body 1 to fix the pitch between the arms 13 of the connector body 1, comprising two clamping walls 31 perpendicularly raised from two distal ends thereof in same direction, two first plug strips 34 and two second plug strips 33 symmetrically formed integral with the clamping walls 31 and respectively plugged into the first plug holes 132 and second plug holes 133 at the arms 13 of the connector body 1, and two inward tongues 32 respectively formed integral with the clamping walls 31 at an inner side. The first plug strips 33 each have a retaining portion 331. The second plug strips 34 each have a contact 341.

Referring to FIGS. from 1 through 4 again, after installation of the terminals 2 in the connector body 1, the connector body 1 is inserted into the opening 51 at the circuit board 5, enabling the first terminals 21 and the second terminals 22 to be respectively clamped on the top and bottom side walls of the circuit board 5. After engagement of the horizontal coupling groove 121 at each locating block 12 of the connector body 1 with the wall thickness of the circuit board 5, a respective screw 135 is respectively installed in the screw hole 122 at each locating block 12 to fix the connector body 1 to the circuit board 5. After installation of the connector body 1 in the circuit board 5, the supporting plate 3 is fastened to the connector body 1 by plugging the first and second plug strips 33 and 34 of the supporting plate 3 into the first and second plug holes 132 and 133 at the arms 13 of the connector body 1. After installation of the supporting plate 3 in the connector body 1, the retaining portion 331 of each first plug strip 33 is engaged with the peripheral wall of the corresponding first plug hole 132 to secure the supporting plate 3 in position, and the contact 341 at each second plug strip 34 is suspended in the corresponding guide hole 134. At final, the metal grounding members 4 are respectively plugged into the guide holes 134 at the arms 13 of the connector body 1. After installation of the metal grounding members 4, the metal grounding members 4 each have one end disposed in contact with the second plug strip 34 at one end of the supporting plate 3, and an opposite end disposed in contact with a grounding terminal at the circuit board 5.

Figure 5:
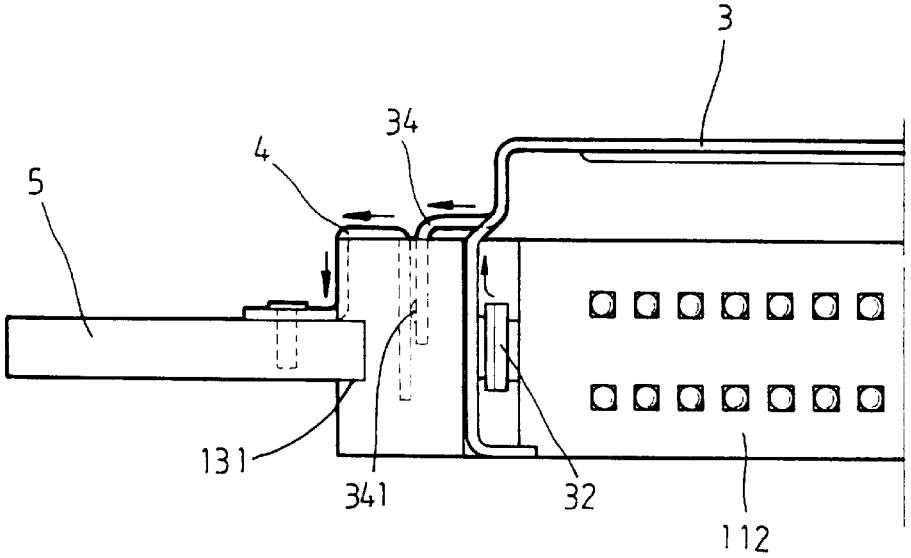
FIG. 5 illustrates the static electricity lead-out path in the memory card connector according to the present invention.

Referring to FIG. 5 and FIG. 3 again, when a memory card 6 is inserted into the receiving space 110 and electrically connected to the terminals 2, the tongues 32 of the metal supporting plate 3 are maintained in contact with two opposite lateral side edges of the memory card 6 positively, enabling static electricity to be guided from the memory card 6 through the metal supporting plate 3 to the grounding circuit of the circuit board 5 via the metal members 4.

While only one embodiment of the present invention has been shown and described, it will be understood that various modifications and changes could be made thereunto without departing from the spirit and scope of the invention disclosed.

What the invention claimed is:

1. A straddle mounting type memory card connector installed in a circuit board to receive a memory card, comprising:

a connector body, said connector body comprising an elongated terminal holder base, two parallel arms perpendicularly extended from two distal ends of said terminal holder base and defining a receiving space for receiving a memory card, and two locating blocks respectively formed integral with said arms and said terminal holder base, said locating blocks each having a horizontal coupling groove respectively engaged with the wall thickness of the circuit board;

two rows of terminals respectively mounted in said terminal holder base at different elevations and clamped on top and bottom side walls of the circuit board in contact with respective contacts at the circuit board for receiving respective terminals at a memory card; and a metal supporting plate mounted on the arms of said connector body to fix the pitch between the arms of said connector body.

2. The straddle mounting type memory card connector of claim 1 wherein the arms of said connector body each have at least one plug hole, and said supporting plate comprises at least one plug strip at each of two distal ends thereof for positioning in the at least one plug hole at the arms of said connector body.

3. The straddle mounting type memory card connector of claim 2 wherein the arms of said connector body each further comprise a guide hole, and a metal grounding member mounted in said guide hole, said metal grounding member having one end disposed in contact with said metal supporting plate and an opposite end for connection to a grounding terminal at the circuit board.

4. The straddle mounting type memory card connector of claim 3 wherein said metal supporting plate comprises two downward clamping walls perpendicularly extended from two distal ends thereof for clamping on two opposite lateral side edges of a memory card, two first plug strips and two second plug strips symmetrically formed integral with said clamping walls and respectively plugged into the at least one plug hole at each of the arms of said connector body for enabling the arms of said connector body to be respectively supported on said clamping walls at an outer side.

5. The straddle mounting type memory card connector of claim 4 wherein said first plug strips each have a retaining portion forced into engagement with the peripheral wall of the corresponding plug hole at the arms of said connector body to secure said metal supporting plate to said connector body.

6. The straddle mounting type memory card connector of claim 4 wherein said second plug strips each have a contact respectively disposed in contact with the corresponding metal grounding member.

7. The straddle mounting type memory card connector of claim 4 wherein said metal supporting plate further comprises two tongues inwardly raised from said clamping walls for engagement with two opposite lateral side edges of a memory card.

8. The straddle mounting type memory card connector of claim 1 wherein said locating blocks of said connector body each have a screw hole perpendicularly disposed in communication with the horizontal coupling groove at the corresponding locating block for the mounting of a respective screw to fix said connector body to the circuit board.

9. The straddle mounting type memory card connector of claim 8 wherein said connector body fits an opening at the circuit board.

10. The straddle mounting type memory card connector of claim 9 wherein the arms of said connector body each have a longitudinal sliding groove at an outer side for coupling to two opposite lateral side edges in the opening at the circuit board.

11. The straddle mounting type memory card connector of claim 10 wherein the longitudinal sliding grooves at the arms of said connector body and the horizontal coupling grooves at the locating blocks at said connector body are respectively disposed in communication with each other on a plane.

* * * * *